US011162752B2

(12) United States Patent
Elftmann, Jr.

(10) Patent No.: US 11,162,752 B2
(45) Date of Patent: Nov. 2, 2021

(54) TRIGGER ASSEMBLY

(71) Applicant: Arthur J. Elftmann, Jr., Glendale, AZ (US)

(72) Inventor: Arthur J. Elftmann, Jr., Glendale, AZ (US)

( * ) Notice: Subject to any disclaimer, the term of this patent is extended or adjusted under 35 U.S.C. 154(b) by 0 days.

(21) Appl. No.: 16/788,270

(22) Filed: Feb. 11, 2020

(65) Prior Publication Data

US 2021/0033365 A1 Feb. 4, 2021

Related U.S. Application Data

(63) Continuation of application No. 15/853,325, filed on Dec. 22, 2017, now abandoned, which is a continuation-in-part of application No. 14/492,065, filed on Sep. 21, 2014, now Pat. No. 9,863,730, which is a continuation-in-part of application No. 13/749,017, filed on Jan. 24, 2013, now Pat. No. 8,881,442.

(51) Int. Cl.

| | |
|---|---|
| ***F41A 19/15*** | (2006.01) |
| ***F41A 19/16*** | (2006.01) |
| ***F41A 19/14*** | (2006.01) |
| ***F41A 19/10*** | (2006.01) |

(52) U.S. Cl.

CPC ..... *F41A 19/15* (2013.01); *F41A 19/10* (2013.01); *F41A 19/14* (2013.01); *F41A 19/16* (2013.01)

(58) Field of Classification Search

CPC ..... F41A 19/10; F41A 19/12; F41A 19/14; F41A 19/15; F41A 19/16; F41A 19/17

USPC ..... 42/65, 69.01–69.03; 89/136

See application file for complete search history.

(56) References Cited

U.S. PATENT DOCUMENTS

| | | | | |
|---|---|---|---|---|
| 361,100 | A | 4/1887 | Wesson | |
| 3,269,045 | A | 8/1966 | McGaughey | |
| 4,908,970 | A * | 3/1990 | Bell | F41A 19/12 42/69.01 |
| 5,548,914 | A * | 8/1996 | Anderson | F41A 17/82 42/65 |
| 5,900,577 | A | 5/1999 | Robinson et al. | |
| 5,913,261 | A | 6/1999 | Guhring | |
| 6,016,736 | A | 1/2000 | Ghisoni | |
| 6,131,324 | A | 10/2000 | Jewell | |
| 6,381,892 | B1 | 5/2002 | Szabo et al. | |
| 6,615,527 | B1 | 9/2003 | Martin | |
| 6,772,548 | B1 | 8/2004 | Power | |
| 7,331,136 | B2 | 2/2008 | Geissele | |
| 7,430,827 | B1 | 10/2008 | Huber | |
| 7,600,338 | B2 | 10/2009 | Geissele | |
| 7,854,084 | B1 * | 12/2010 | Rutherford | F41A 19/10 42/69.01 |
| 8,505,225 | B1 * | 8/2013 | Degener | F41A 19/10 42/69.01 |

(Continued)

OTHER PUBLICATIONS

Bob Boyd, Elftmann Tactical: Dual Enhancement Trigger (D-TR), on-line article from www.shootingillustrated.com, Oct. 26, 2012.

(Continued)

*Primary Examiner* — Bret Hayes

(74) *Attorney, Agent, or Firm* — Law Offices of Lisa & Lesko LLC; Justin Lesko, Esq.

(57) ABSTRACT

Trigger assembly for use in a weapon. Components of the trigger assembly include a spring, a hammer, a disconnector, a trigger and other components related to a trigger assembly.

12 Claims, 15 Drawing Sheets

(56) References Cited

U.S. PATENT DOCUMENTS

| | | | | |
|---|---|---|---|---|
| 9,863,730 | B2 * | 1/2018 | Elftmann | F41A 19/10 |
| 2003/0178018 | A1 | 9/2003 | Cherry | |
| 2006/0086031 | A1 | 4/2006 | Geissele | |
| 2007/0266845 | A1 | 11/2007 | Polston | |
| 2009/0178322 | A1 | 7/2009 | Dye, Jr. | |
| 2009/0266348 | A1 | 10/2009 | Yeh | |
| 2010/0295222 | A1 | 11/2010 | Lee | |
| 2011/0173859 | A1 | 7/2011 | Findlay | |
| 2014/0259845 | A1 | 9/2014 | Johnson | |
| 2014/0338523 | A1 | 11/2014 | Daley, Jr. | |

OTHER PUBLICATIONS

Clair Rees, Rifle Firepower magazine, DIY Smithing, Trigger TurboBoost, Jul. 2013, pp. 80-81, Harris Publications, New York, USA.

* cited by examiner

TRIGGER ASSEMBLY

CROSS REFERENCE TO RELATED APPLICATION

This application is a Continuation-In-Part of U.S. application Ser. No. 14/492,065, filed Sep. 21, 2014 which is a Continuation-In-Part of U.S. application Ser. No. 13/749,017, filed Jan. 24, 2013 issued as U.S. Pat. No. 8,881,442 on Nov. 11, 2014. This patent is incorporated by reference in its entirety. This application claims the benefit of provisional Application 61/880,947, filed Sep. 22, 2013. This earlier filed application is hereby incorporated by reference in its entirety.

BACKGROUND OF THE INVENTION

Field of the Invention

This invention is a drop-in modular trigger assembly for use in replacing the stock trigger assembly of a semi-automatic rifle such as the "Colt" brand, "AR-15" brand ("Colt" and "AR-15" are trademarks of Colt Industries) as well as similar semi-automatic rifles or clones of the "Colt" "AR-15" semi-automatic rifle made by many companies throughout the world. The device is a replacement of the stock or original equipment trigger assembly carried in the lower receiver portion of a semi-automatic rifle. This drop-in modular trigger assembly is made to replace the original trigger provided with the stock rifle without impairing the functionality of the original rifle. The drop-in modular trigger assembly presented here can also be used in rifles other than the AR-15 family of rifles having a removable trigger assembly.

Description of Known Art

It is known to use modular replacement trigger assemblies to replace the stock trigger assemblies on various automatic weapons. Manufactures of drop in triggers include, among others, CMC Triggers, Timney Triggers and High Performance Firearms Accessories.

It is known that stock triggers in AR-15 style rifles have triggers with accuracy-robbing characteristics, such as, but not limited to, excessive trigger take-up and a propensity to accumulate grit in the trigger mechanism causing trigger creep that makes for inconsistent trigger let-off. As will be addressed further on, the drop-in modular trigger presented here overcomes those shortcomings and provides a trigger that enhances the accuracy of an AR-15 and of other rifles that can accommodate a drop in replacement trigger assembly.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides, among other things, a drop-in trigger module for use as a direct replacement of the standard trigger of an AR-15 style semi-automatic rifle. In one embodiment of this invention the drop-in modular trigger assembly includes a needle bearing supported pivot points, an adjustable sear, an adjustable disconnector, a hammer with a safety notch (also referred to herein as a "ratchet element" or "ratchet detent") and, in one embodiment, a second safety notch (also referred to herein as a "ratchet element" or "ratchet detent") in the hammer, and a further adjustment hardware.

An object of this invention is to provide a drop-in modular trigger that is easily installed in the lower receiver of an AR-15 style semi-automatic rifle.

It is also an object of the invention to provide a drop-in modular trigger that is a direct fit into a lower receiver of an AR-15 style semi-automatic weapon without the need for any special tools, machining operations, or gunsmithing experience.

Another object of this invention is to increase the firing rate of a semi-automatic AR-15 style rifle by providing a more efficient trigger assembly.

A further object of the invention is to provide a drop-in modular trigger with a dual trigger configuration.

It is also an advantage of this drop-in modular trigger to lower the trigger pull effort rate to provide for single precision shots from a semi-automatic rifle.

Another advantage of this drop-in modular trigger is that the pull weight of the trigger is reduced.

A further advantage is that the trigger enables better utilization of ammunition as the accuracy of the rifle is improved.

Another object of the invention is to provide a drop-in modular trigger replacement that can easily be installed in less than an hour without the need to hire a gunsmith to do the installation.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35

U.S.C. § 112, ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWING

A more complete understanding of the present invention may be derived by referring to the detailed description when considered in connection with the figures in which.

Elements depicted in the figure are illustrated for simplicity. They are presented to illustrate the invention to assist in an understanding thereof. The figures are not necessarily rendered according to any particular sequence, size, scale or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

It should also be pointed out that the front of the trigger assembly is the direction that finger contacting portion of the trigger faces. The back or rear of the trigger assembly is the direction that the trigger is pulled when being fired. That is, the trigger is pulled back when being fired. The trigger is generally mounted to the rifle such that the trigger is pointed away from the lower receiver in a downwardly facing direction as is usual.

Figure 1:
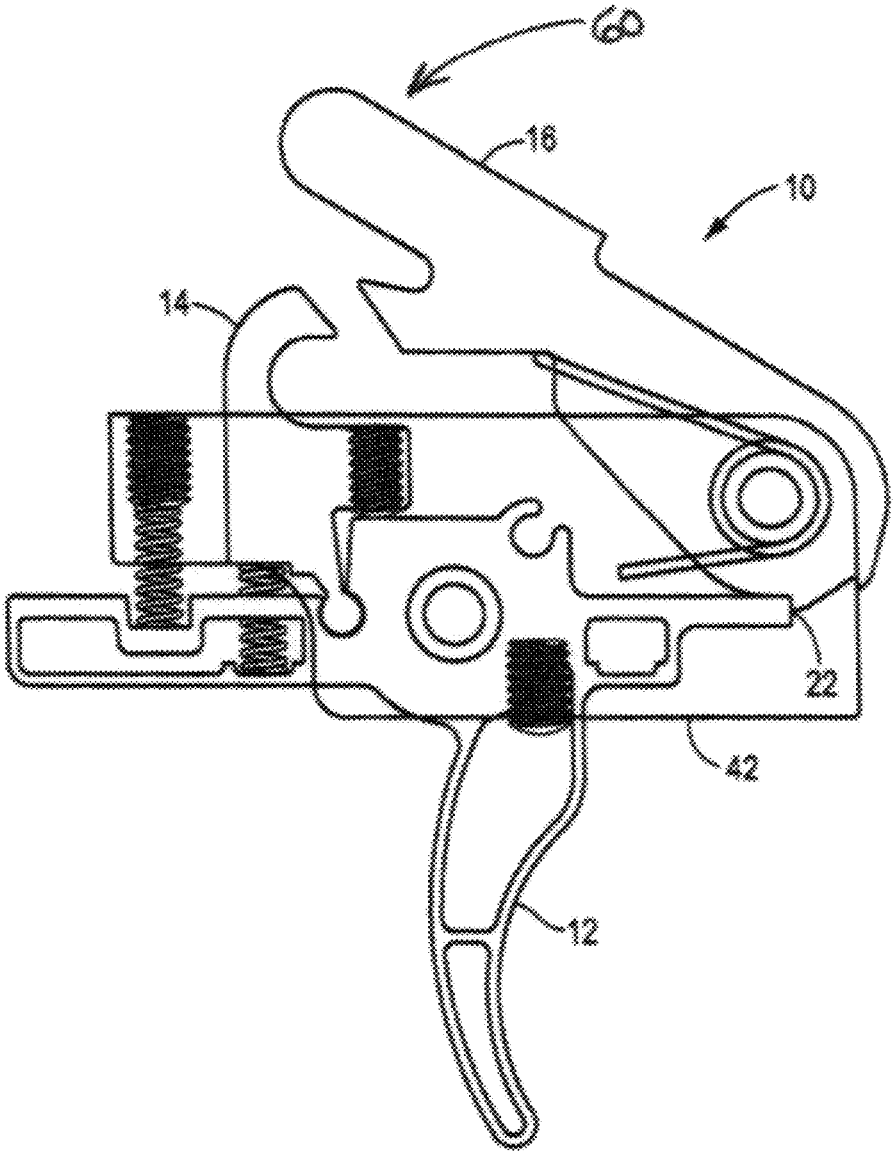
FIG. 1 is a side elevation view with parts broken away to show various elements of one embodiment of a drop-in modular trigger.

Turning to FIG. 1, the drop-in modular trigger assembly is shown. Included in this figure are, among other elements, the housing 42, the hammer generally 60, having a hammer-striking surface 16, and the hammer 60 having two ratchet elements, the torsion spring 18, the disconnector 14, a single trigger 12, and various adjustment screws.

In each of the figures of the drop-in modular trigger a side of the housing has been removed to show the internals of the drop-in modular trigger. For instance, in FIGS. 1-6 only a portion of the housing 42 is shown as the right angle corner at the lower left side of each figure. The housing will extend from the left side of the drop-in modular trigger assembly along the bottom side of the drop-in modular trigger assembly and up the right side of the drop-in modular trigger assembly. The drop-in modular trigger assembly housing is machined or formed with orifices and openings to allow proper mounting, component location and retention and operation of the drop-in modular trigger assembly. A portion of the drop-in modular trigger assembly housing may extend over the top of the housing and may extend along both or either end of the drop-in modular trigger assembly.

Figure 2:
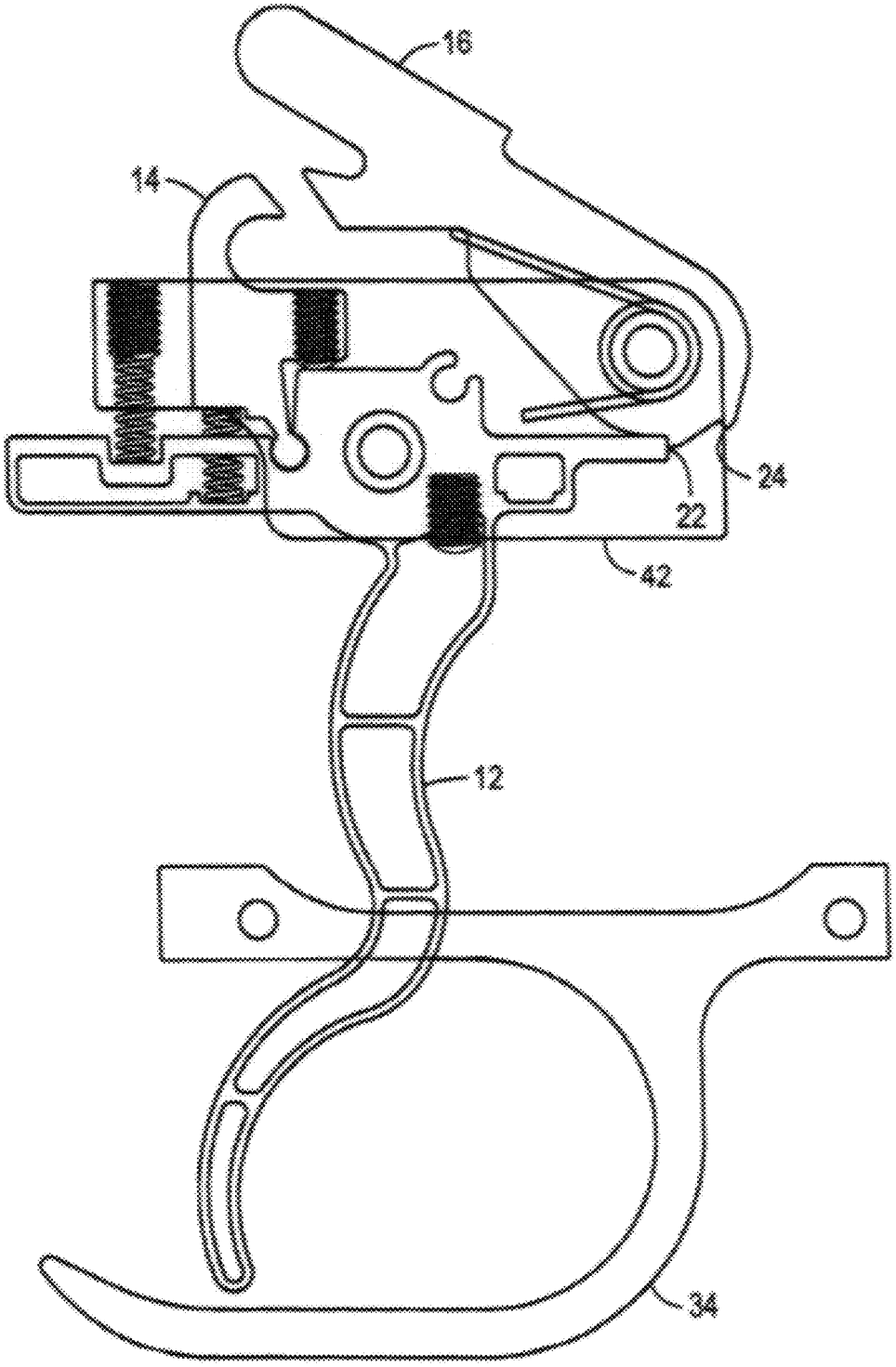
FIG. 2 is a side elevation view with parts broken away to show various elements of one embodiment of a drop-in modular trigger having a dual trigger.

FIG. 2 is similar to FIG. 1 with a dual trigger instead of a single trigger as well as a trigger guard 34.

Figure 3:
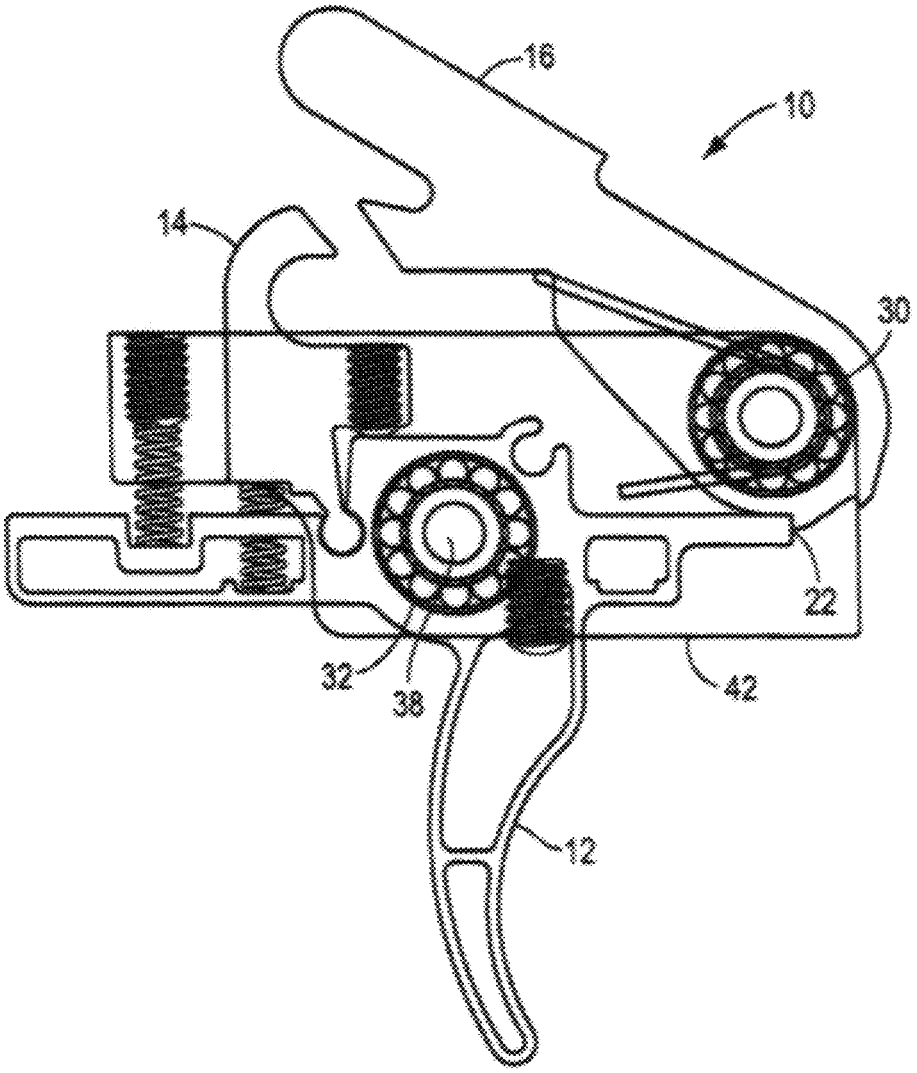
FIG. 3 is a side elevation view with parts broken away to show various elements of one embodiment of a drop-in modular trigger with needle bearings at two pivot points.

FIG. 3 shows another embodiment of the drop-in modular trigger assembly. Included in this figure are, among other elements, the housing, the hammer with two ratchet elements, the torsion spring, the disconnector, a single trigger, needle bearings at two pivot points and various adjustment screws. Needle roller bearings 30 and 32 are used on the hammer pivot point and at the pivot point of the trigger respectively.

Figure 4:
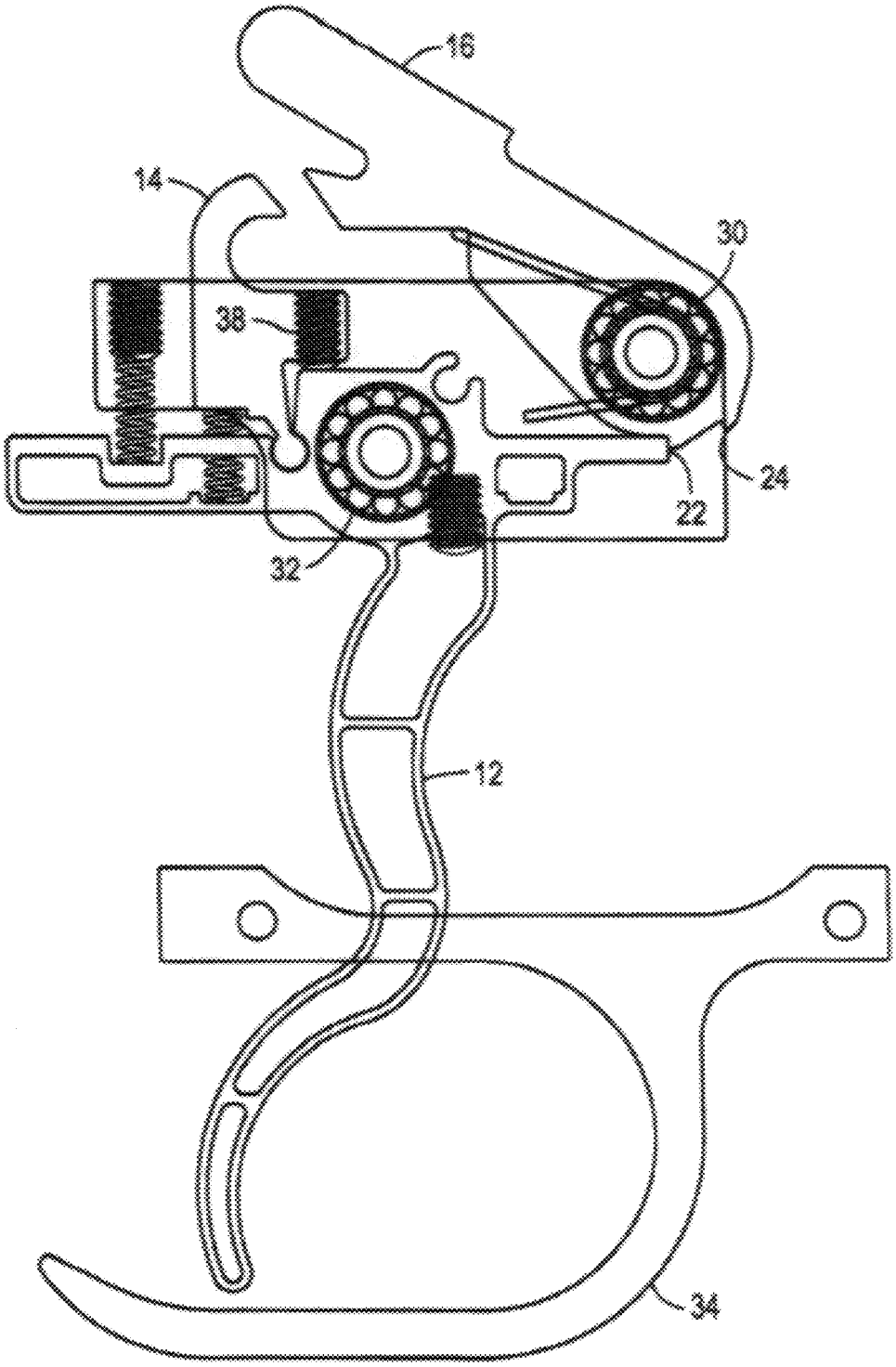
FIG. 4 is a side elevation view with parts broken away to show various elements of one embodiment of a drop-in modular trigger having needle bearings and a dual trigger.

FIG. 4 is similar to FIG. 3 with a dual trigger, also identified as item 12, instead of a single trigger as well as a trigger guard.

Figure 5:
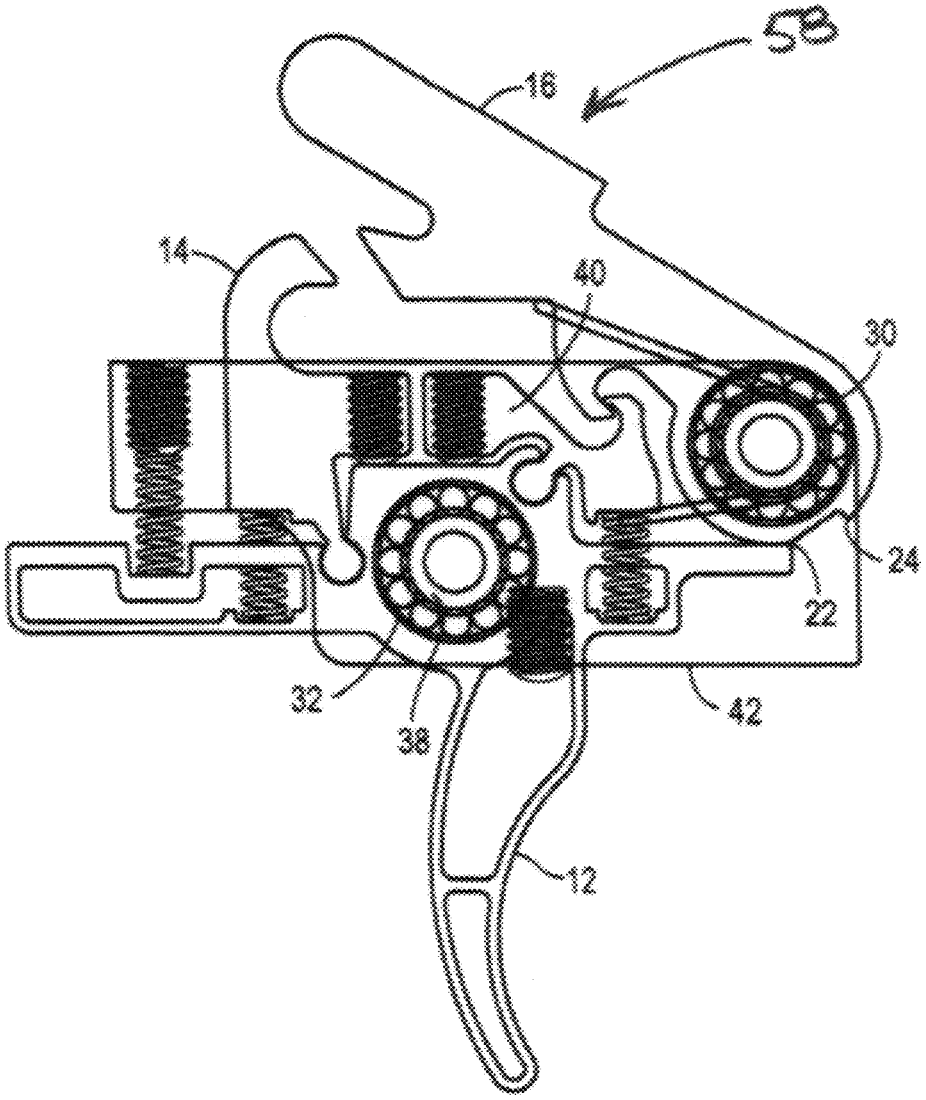
FIG. 5 is a side elevation view with parts broken away to show various elements of one embodiment of a drop-in modular trigger having multiple adjustment elements.
Figure 6:
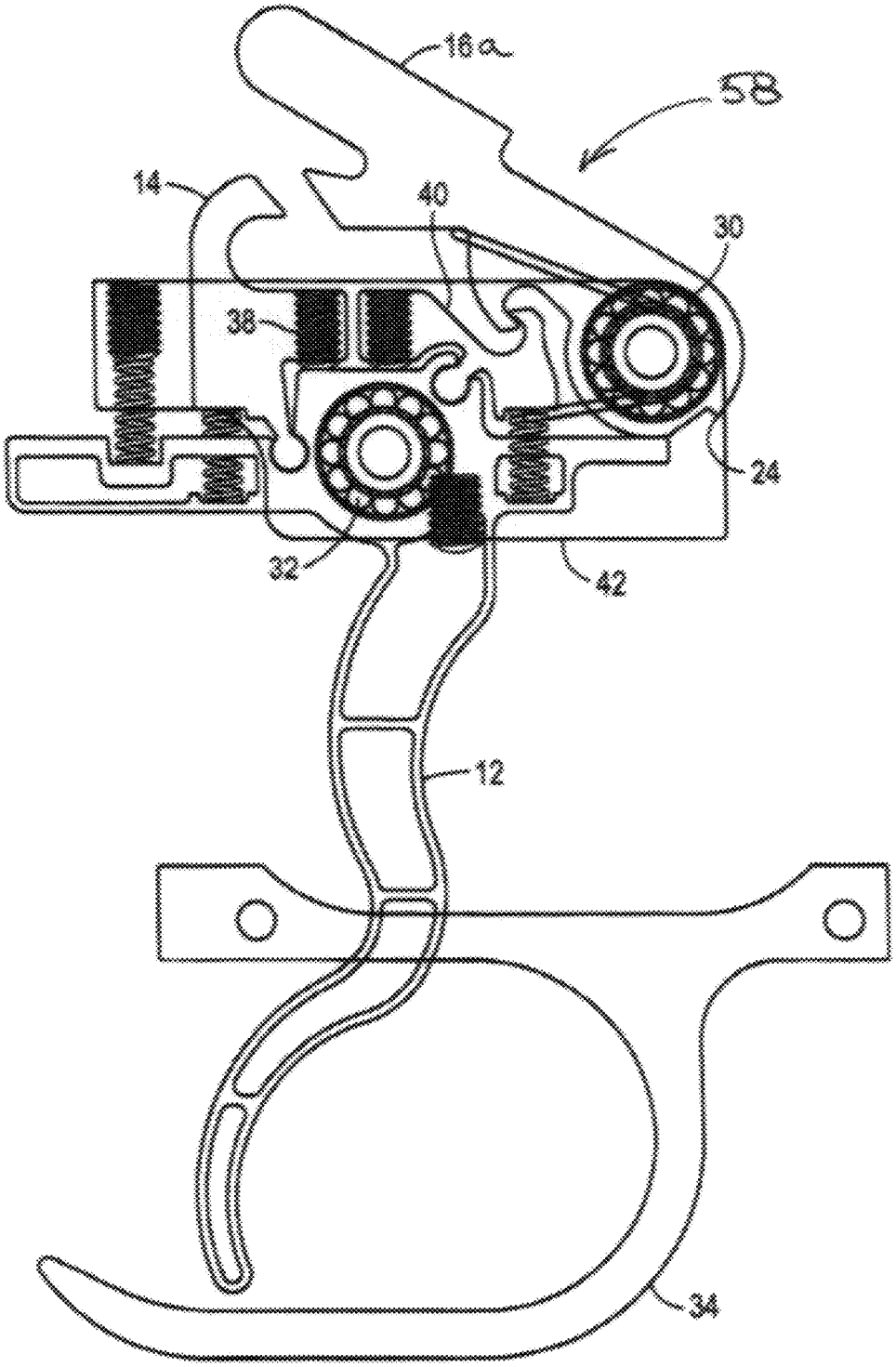
FIG. 6 is a side elevation view with parts broken away to show various elements of one embodiment of a drop-in modular dual trigger having multiple adjustment elements and a dual trigger.

FIG. 5 shows another embodiment of the drop-in modular trigger assembly. Included in this figure, among other elements, are the housing, an alternative hammer embodiment, herein called an "ultra-hammer 58, the torsion spring, the disconnector, a sear, a single trigger, needle bearings at two pivot points and various adjustment screws. It is contemplated by the inventor that the ultra-hammer 58 in this embodiment could; alternatively, be a hammer with two ratchet elements, these being the firing notch 22, and the safety notch 24, as shown in FIG. 3 FIG. 6 shows another embodiment of the drop-in modular trigger assembly. Included in this figure, among other elements, are the housing, an alternative hammer embodiment, the torsion spring, the disconnector, a sear, needle bearings at two pivot points and various adjustment screws, and a dual trigger as well as a trigger guard. It is contemplated by the inventor that the hammer in this embodiment could; alternatively, be a hammer with two ratchet elements as shown in FIG. 4.

Figure 7:
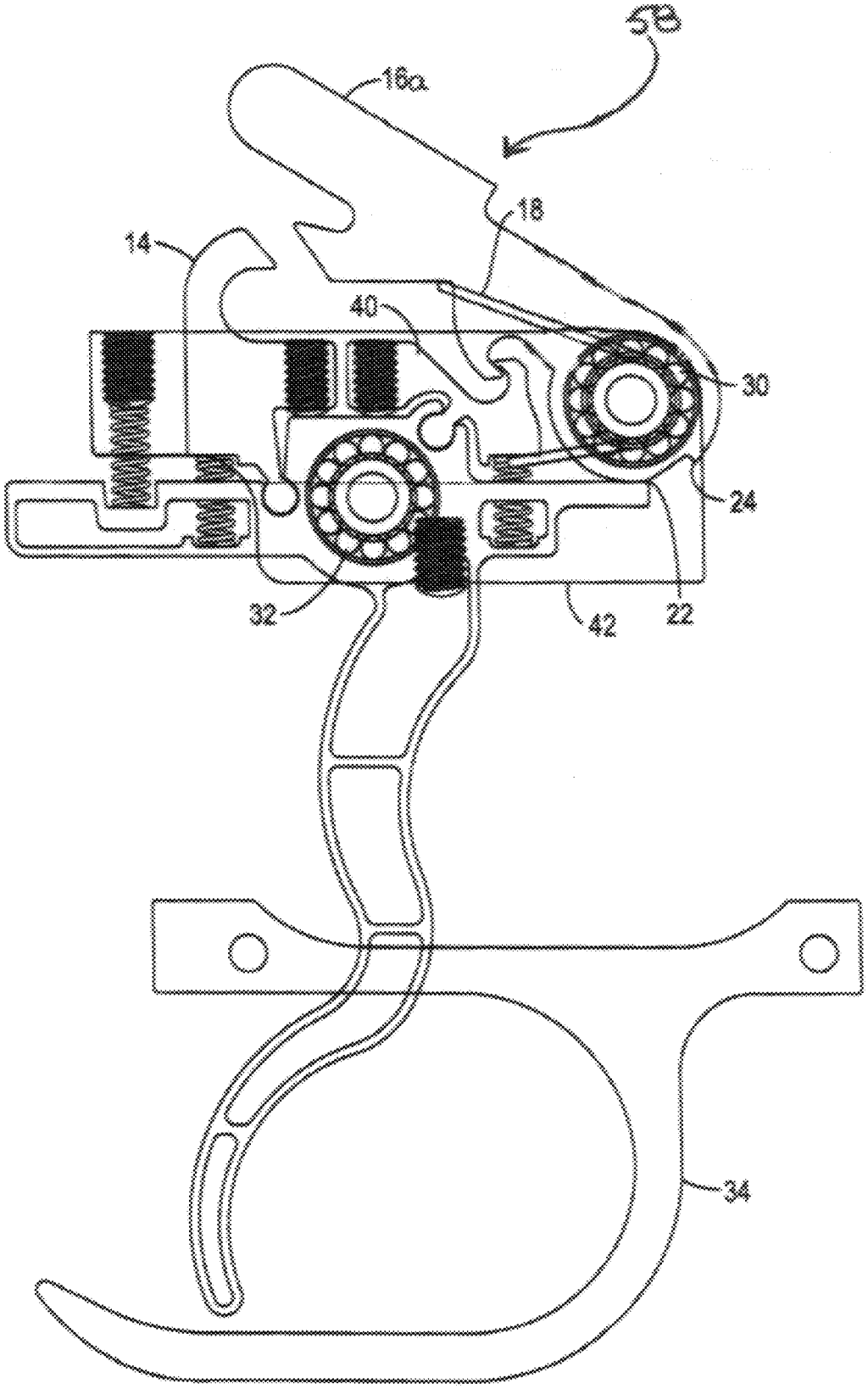
FIG. 7 is a side elevation view with parts broken away to show various elements of one embodiment of a drop-in modular dual trigger having multiple adjustment elements and a dual trigger.

FIG. 7 is an embodiment of the drop-in modular trigger assembly. Included in this figure, among other elements, are the housing 42, an alternative hammer embodiment, the torsion spring 18, the disconnector 14, a sear 40, needle bearings 30 and 32, at two pivot points and various adjustment screws, and a dual trigger as well as a trigger guard 34. It is contemplated by the inventor that the ultra-hammer 58 in this embodiment could; alternatively, be an ultra-hammer with two ratchet elements 22 and 24 as shown in FIG. 4.

Figure 8:
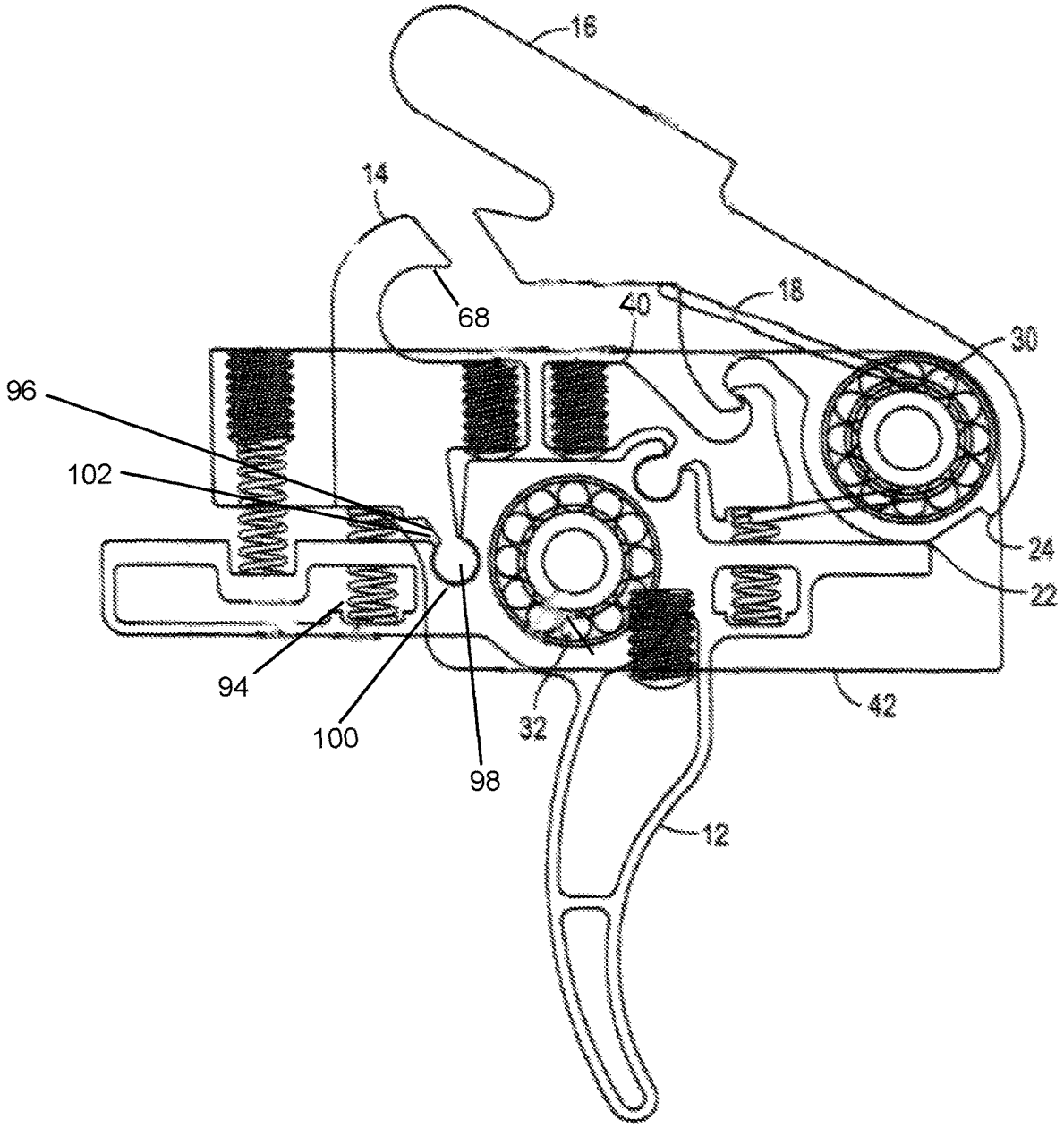
FIG. 8 is a side elevation view with parts broken away to show various elements of one embodiment of a drop-in modular trigger having multiple adjustment elements.

FIG. 8 is an embodiment of the drop-in modular trigger assembly. Included in this figure, among other elements, are the housing 42, an alternative hammer embodiment, the torsion spring 18, the disconnector 14, a sear 40, a single trigger 12, needle bearings 30 and 32 at two pivot points and various adjustment screws. It is contemplated by the inventor that the hammer in this embodiment is, alternatively, a hammer with two ratchet elements 22 and 24 as shown in FIG. 4.

Figure 9:
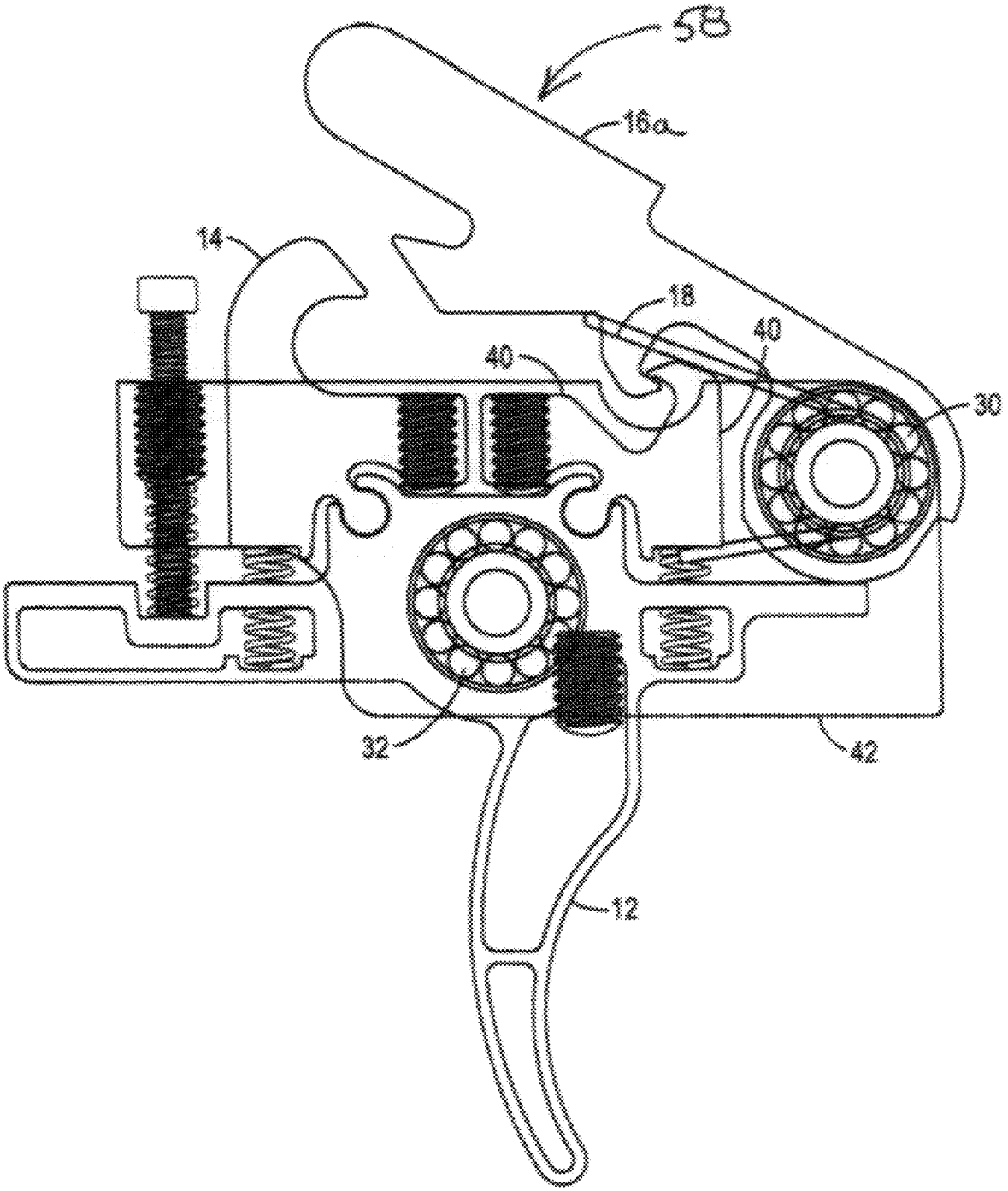
FIG. 9 is a side elevation view with parts broken away to show various elements of one embodiment of a drop-in modular trigger having multiple adjustment elements.

FIG. 9 is an embodiment of the drop-in modular trigger assembly. Included in this figure, among other elements, are the housing 42, a hammer 16, the torsion spring 18, an alternative disconnector 14, a sear 40, an alternative single trigger 12, needle bearings 30 and 32 at two pivot points and various adjustment screws. It is contemplated by the inventor that the hammer in this embodiment is, alternatively, a hammer with two ratchet elements as shown in FIG. 4. The ratchet detents operate as safety devices to prevent the accidental firing of the weapon.

Figure 10:
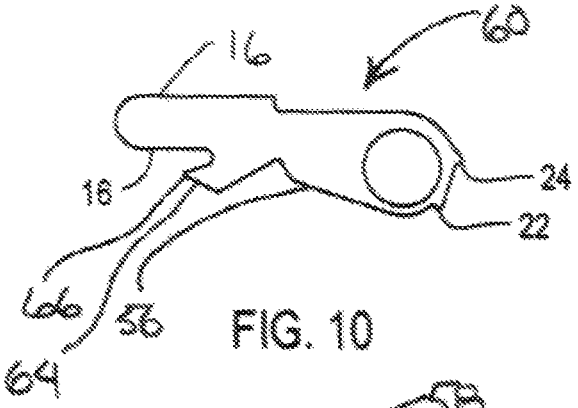
FIG. 10 is a side elevation view of one embodiment of a hammer.

FIG. 10 is a side elevation view of a hammer having two ratchet elements 22 and 24 or ratchet detents. This hammer includes a firing notch 22 and a safety notch 24.

Figure 11:
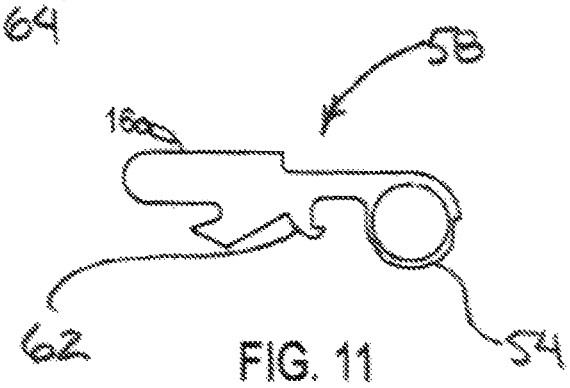
FIG. 11 is a side elevation view of one embodiment of a hammer.

FIG. 11 is a side elevation view of an alternative hammer. At the bearing-receiving end of this hammer, what shows as a large hole in the body of the hammer, is a cam 54 having a slightly enlarged portion that operates as a cam surface. In comparing the FIG. 11 hammer with the hammer shown in FIG. 10 there is noted a significant difference between these two hammers. In FIG. 10 the relative lower surface 56 of the trigger body is, for the most part, comprises a straight portion. In contrast, the FIG. 11 hammer, which has been referred to as an "ultra-hammer" in the figure, has a significantly different configuration. The relative lower surface of the "ultra hammer," generally 58 includes a sear interface 62 that will interface in a latched and subsequently unlatched relationship with the sear shown in FIGS. 5, 8, 9, and 13 (as well as in several of the dual trigger embodiments). This embodiment could also have two ratchet elements or ratchet detents as shown in FIG. 10.

The hammer shown in the single trigger embodiments in FIGS. 1, 3 10 (as well as in several of the dual trigger embodiments) has a disconnector interface 64 with a catch projection 66 that will interface in a restraining relationship with the disconnector 14 catch edge 68 until the trigger is pulled and the catch projection 66 is released from the catch edge 68.

Figure 12:
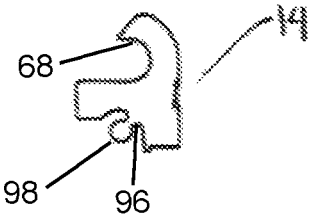
FIG. 12 is a side elevation view of a one embodiment of a disconnector.

FIG. 12 is one embodiment of a disconnector, generally 60, as used in FIG. 9.

Figure 13:
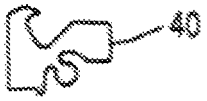
FIG. 13 is a side elevation view of a one embodiment of a sear.

FIG. 13 is one embodiment of a sear.

Figure 14:
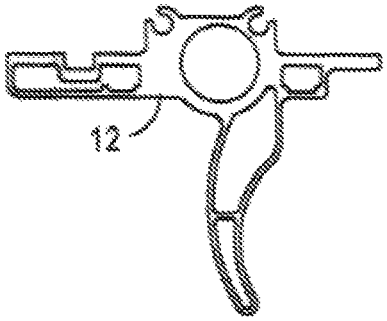
FIG. 14 is a side elevation view of a single trigger for use in the drop-in modular trigger assembly.

FIG. 14 is an embodiment of a single trigger 12.

Figure 15:
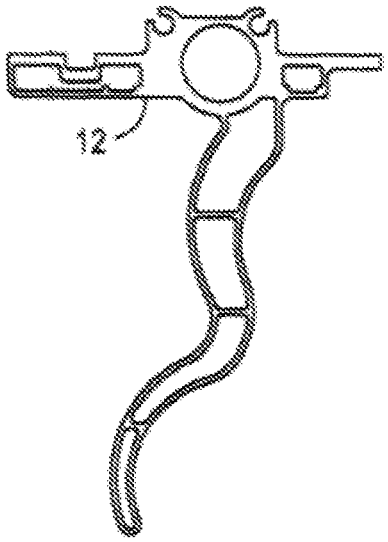
FIG. 15 is a side elevation view of a double trigger for use in the drop-in modular trigger assembly.

FIG. 15 is an embodiment of a dual trigger also shown as 12.

Figure 16:
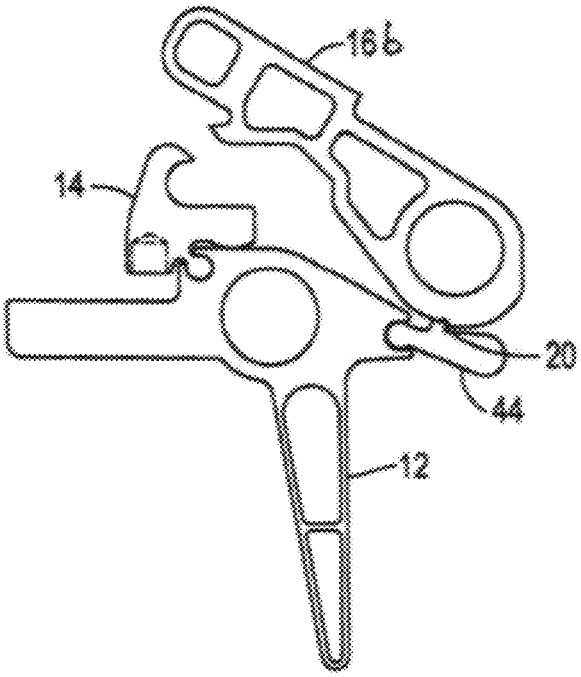
FIG. 16 is a side elevation view of a trigger and hammer having a catch notch on the hammer.
Figure 17:
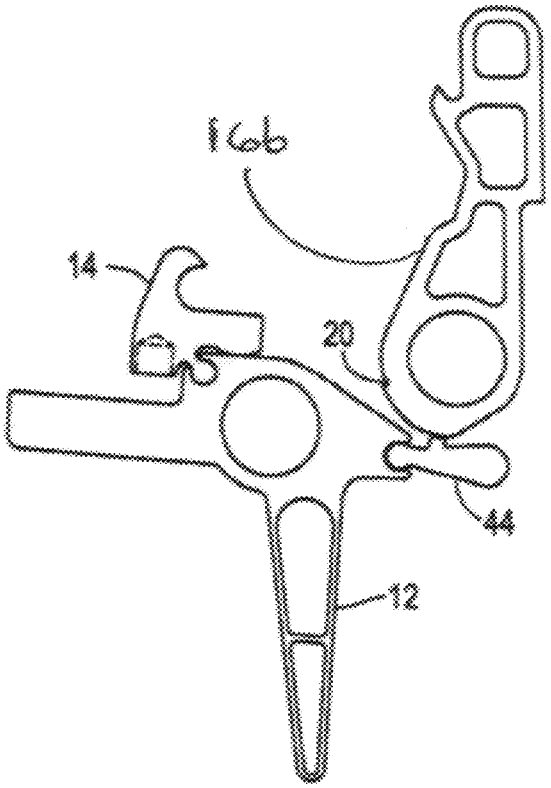
FIG. 17 is the trigger and hammer shown in FIG. 16 with the hammer in a released position.

FIGS. 16 and 17 show one embodiment of a trigger and hammer assembly. In this embodiment FIG. 16 shows the hammer 16 in a partially deployed state with a release pawl 44 preventing the further movement of the hammer to a firing position. In FIG. 17 the release pawl has been released from interference with the notch 20 allowing the hammer to complete its travel to contact the firing pin of the weapon.

Figure 18:
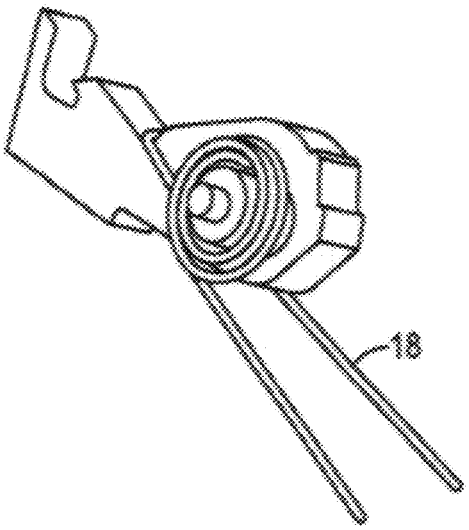
FIG. 18 is a depiction of a trigger and hammer having notches on the hammer.
Figure 19:
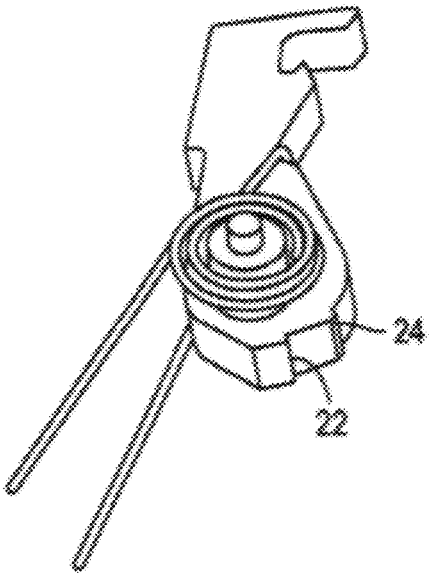
FIG. 19 is the trigger and hammer shown in FIG. 18 from a different viewing angle.

FIGS. 18 and 19 show one embodiment of the invention. In these views the hammer spring 18 is a double/double torsion spring. In this wound configuration the torsion spring can fit inside the housing without extra machining of the housing.

Figure 20:
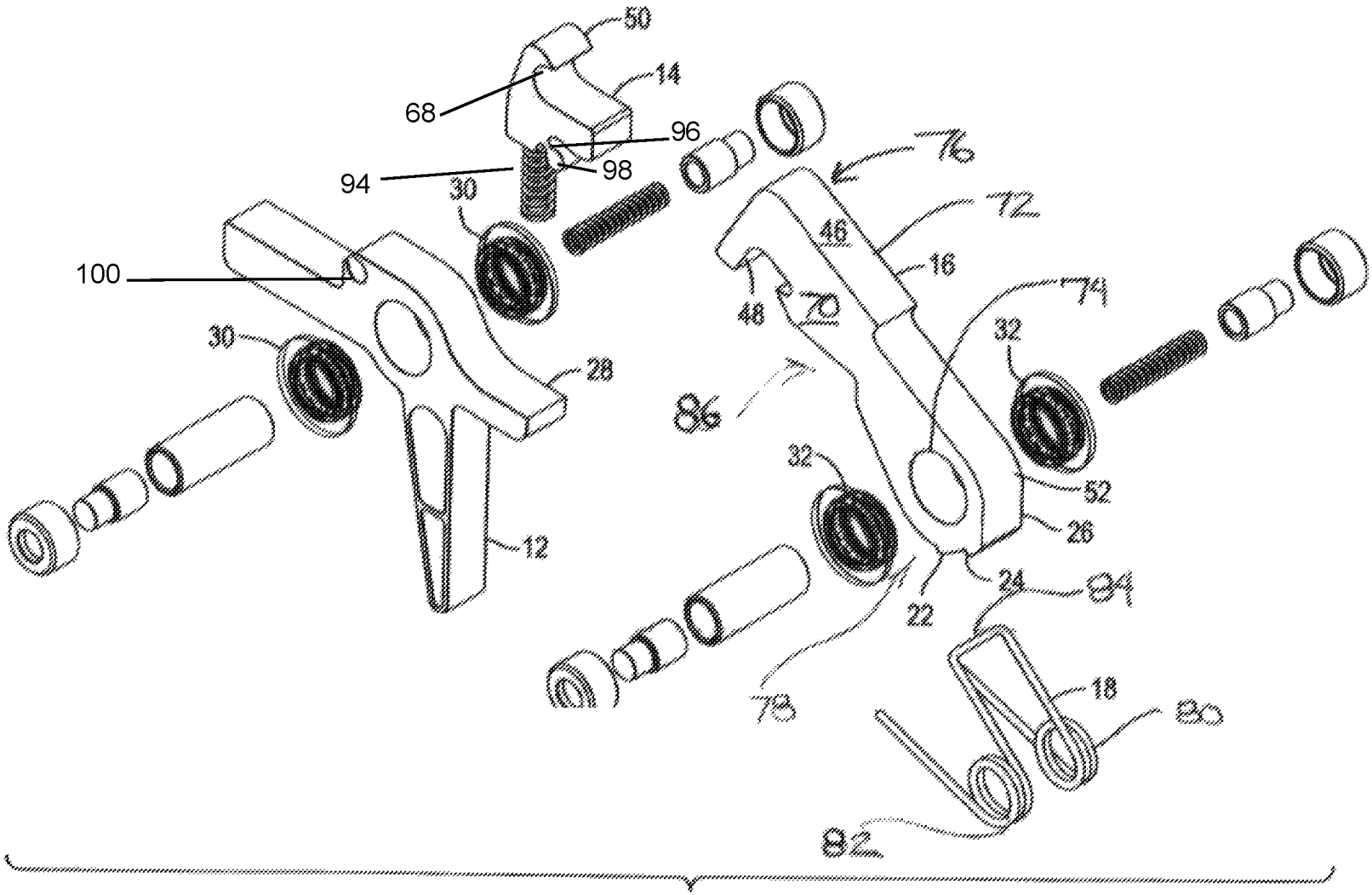
FIG. 20 is an expanded view of a trigger and hammer assembly for use in an AR-15 style weapon.

FIG. 20 shows an expanded view of a trigger assembly for use in an AR-15.

Figure 21:
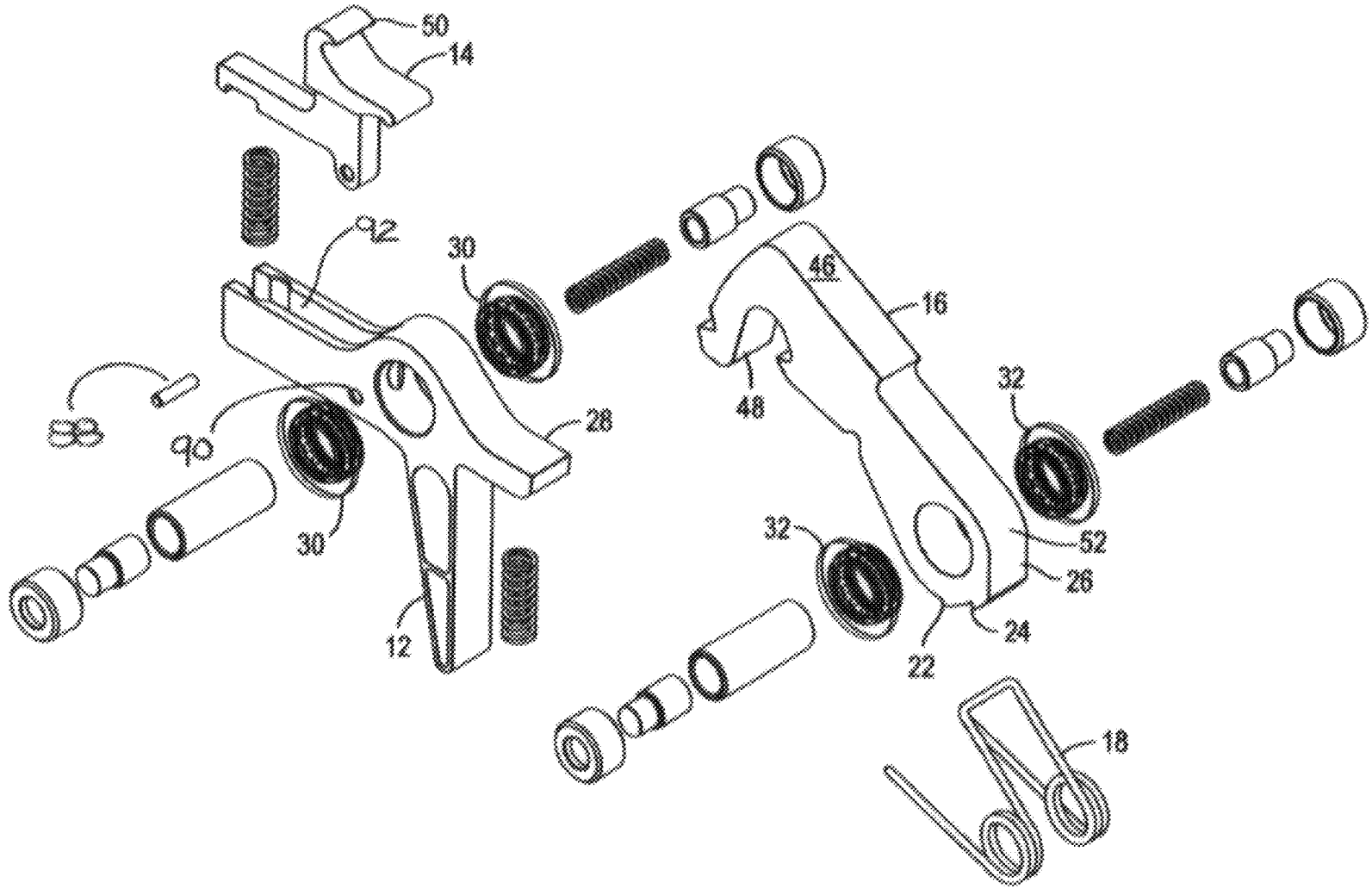
FIG. 21 is an expanded view of a trigger and hammer assembly for use in an M-16 style weapon.
Figure 22:
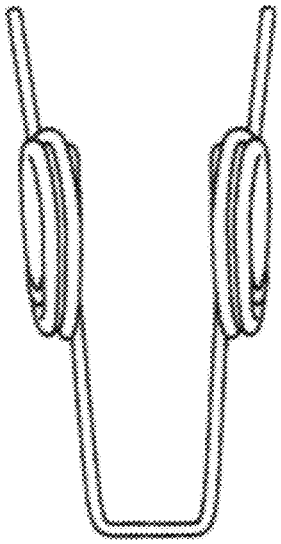
FIG. 22 is a top view of a wound spring.
Figure 23:
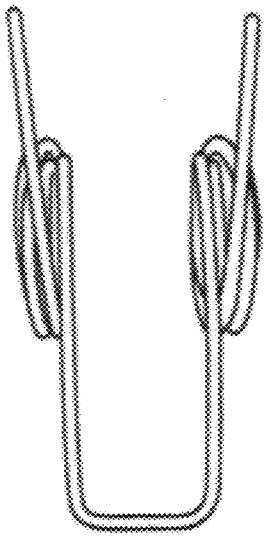
FIG. 23 is a bottom view of the wound spring shown in FIG. 22.
Figure 24:
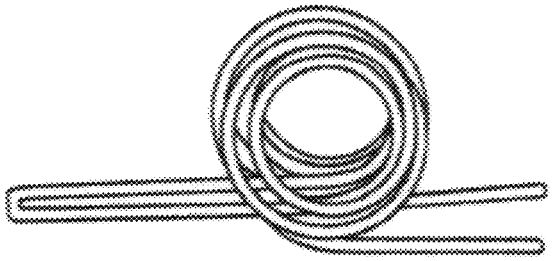
FIG. 24 is a side view of the spring shown in FIGS. 22 and 23.

FIG. 21 shows an expended view of a trigger assembly for use in an M-16.

The embodiments shown in FIGS. 20 and 21 have differences dictated by the intended use of the trigger assembly. One common element of these two embodiments is the firing notch 22 and safety notch 24.

In some embodiments depicted in the drawings (for example, the embodiments shown in FIGS. 1-8, 12, and 20, as well as others), the disconnector 14 has a catch edge 68 that is configured to be urged by a spring 94 to a position that restrains the hammer 16 from rotation until the trigger 12 is pulled, and the disconnector 12 also has a projection (96, 98) that interconnects the disconnector 14 to trigger shoe 12. The projection comprises a neck 96 and a head 98, and the trigger shoe 12 has a slot 100 for receiving the projection, wherein the head 98 fits into the slot 100 and the slot 100 includes a gap 102 configured to enable movement of the neck 96 such that the trigger 112, when pulled, will urge the catch edge 68 away from the hammer 16 against the spring's force thereby releasing the hammer 16 to fire the weapon.

The invention presented here, with the firing notch and safety notch on the hammer, presents a safer trigger than triggers currently on the market. This safety hammer, having the firing notch and safety notch prevents a double fire of the trigger mechanism.

In the trigger presented here there are four main subassemblies, as in normal triggers of this type, comprising the trigger. These are the hammer, the trigger itself, the disconnector and the hammer spring.

However, one element of improvement in this trigger assembly is that the hammer spring, shown as item 18, is a specially wound double torsion spring. It may be referred to as double/double torsion spring. In this spring, unlike any other spring in similar trigger assemblies, is a spring that is wound in layers. There are five coils in this spring. Normally a gun trigger hammer spring for an AK-47 or AR-15 is wound in a single layer of coils. Because of the available clearance in the trigger housing 42 the standard trigger is limited to three coils on each side of the centerline of the spring. In the "double-double" wound coil torsion spring used in the s trigger presented here there are five coils on each side of the centerline of the spring. This spring configuration, the "double-double" configuration, has an overall width less than the conventional "double" configuration with three coils on each side of the spring.

In most trigger configurations the hammer spring is partially carried in a machined channel formed on each side of the hammer around the trigger pivot point. The machined groove isn't needed with the "double-double" torsion spring shown in, for example, FIGS. 20 and 21, and used in the inventor's trigger. Since the "double-double" torsion spring is wound in a stacked coil configuration the coil stacking height is less than the double torsion spring coil stacking height by a very significant amount. An amount resulting in a spring that can be mounted to a trigger without the need for a relief grove or channel being formed in the hammer body itself.

This can be seen in several of the figures, for instance, in FIG. 20, there is a hammer surface 46, generally at the hammer end of the hammer body. The hammer surface, as is well known, is used to contact a firing pin when the trigger is pulled. In the hammer embodiment of FIG. 20, there is a spring 18 having a left side 80 and a right 82 side, the two sides separated by a non-wound section 84 of the bent and coiled wire spring. The non-wound section 84 of wire connects the right side 82 of the hammer spring to the left side 80 of the hammer spring 18. In one embodiment the hammer of the trigger and hammer assembly comprise a hammer body, generally 86 with a hammer end, generally 76 and a through bore end, generally 78 of FIG. 20. This hammer body 86 has both a first side surface 70 and a second side surface 72 with these surfaces extending from the hammer end 76 of the body to the through bore end 74 of the hammer body. The side surfaces, one being the first side surface 70 of the hammer and the opposite side surface being the second side surface 72 of the hammer, are each flat surfaces with each flat surface generally perpendicular to the hammer surface 46 of the hammer body 86.

In various figures the hammer is shown in an elevation view. In one embodiment the trigger assembly is for an AR-15 semiautomatic rifle. The actual hammer surface is surface 46 in FIGS. 20 and 21. Extending downwardly from the hammer surface is the tail 48. Inboard from the tail, in the direction of the hammer bearing is the lower disconnector hook. This lower disconnector hook will interface with the trigger disconnector hook 50. The bearing 32 of the hammer is carried in a bore of the hammer body. The bore is sized to provide a press fit with the bearing so the bearing is retained in the bore. The bearing 32 used in this invention is a needle roller bearing of the style having rolling pins carried in a bearing housing. One such needle roller bearing is manufactured by Timken in the United States.

The end of the hammer furthest away from the tail 48 and outboard of the bearing comprises a lobe having three functional items. These are the firing notch 22, a safety notch 24, and a curved landing flat 52. As is well known, the firing notch 22 will interface with the sear 28 of the trigger element. In certain circumstances the safety notch will also interface with the sear, most usually to prevent the accidental firing of the host weapon. The curved landing flat 52 will facilitate smooth travel of the sear along the hammer lobe allowing more rapid reset of the trigger.

The trigger element comprises a trigger shoe 12, the sear 28 carried on the sear arm. A central bore of the trigger element will locate a trigger needle bearing 32. The disconnector 14 is carried in a trigger pivot recess 92 by means of a disconnector pivot shaft 88. The pivot shaft 88 is a generally longitudinal bar element having a diameter closely fitted to match the pivot recess bore 90 that houses the disconnector pivot shaft 88. The pivot shaft can rotate a small arcuate distance in the pivot recess. The disconnector 14 is spring loaded, using a spring to urge the disconnector 14 into a position that will restrain the hammer 16 from rotation until the trigger is pulled. The spring 94 is positioned in the trigger pivot recess 92 of the trigger, and the spring 94 is also in contact with the disconnector.

As is usual in a trigger of this type there is a safety tail to interface with the safety of the rifle.

It is preferred to cast, machine, or fabricated the drop-in modular trigger assembly from aluminum with steel or other hard metal elements in wear zones or areas where the trigger contacts other components of the rifle such as, but not limited to, the insertable hammer contact element. The inventor also contemplates making the drop-in modular trigger assembly from non-aluminum metals, such as, but not limited to steel, or from non-metallic materials such as high performance plastics or other polymer based materials. Metal inserts may be necessary at wear points when non-steel materials are used to form the trigger.

The layout and structure of the drop-in modular trigger assembly allows the drop-in modular trigger assembly to be fitted directly into the location of the original trigger on an AR-15, after the stock trigger assembly has been removed from the lower receiver. No machining of the lower receiver assembly is required. No special gunsmithing skills are needed. The whole replacement of the original single trigger assembly with the drop-in modular trigger assembly is easily done by the owner of an AR-15 semi-automatic or similar rifle.

The invention includes the method of retrofitting a dual trigger assembly to an AR-15 or an AR-15 look-alike or clone. It is anticipated by the inventor that this drop-in modular trigger assembly could be used with firearms other than the AR-15. Some detail modifications may be necessary to the embodiments shown here but these modifications would be addressed more to mounting, fitting and structural considerations to make a drop-in modular trigger assembly for a particular firearm.

Operation using the drop-in modular trigger assembly may be found to be easier to operate, faster to operate and more versatile then the original trigger design. Since no modifications to the lower receiver assembly was necessary in the conversion it is simply a matter of removing the drop-in modular trigger assembly and reinstalling the trigger assembly parts in the event it is necessary or desirable to return the rifle to its original trigger configuration.

In summary, one of the inventions described herein is a hammer having a hammer surface that is used to contact a firing pin when the trigger is pulled. In this hammer embodiment, which is for use in a trigger and hammer assembly used in a weapon having hammer spring formed of a single length of bent and coiled wire. This hammer spring has a left and a right side separated by a non-wound section of the bent and coiled wire. The non-wound section of wire connects the right side of the hammer spring to the left side of the hammer spring, and this hammer spring has a spring with both the left and right sides of the hammer spring wound in layers. In one embodiment claimed, the hammer of the trigger and hammer assembly comprise; a hammer body with a hammer end and a through bore end. This hammer body has both a first side surface and a second side surface with these surfaces extending from the hammer end of the body to the through bore end of the hammer body. The side surfaces are each being a flat surface with each flat surface generally perpendicular to the hammer surface of the hammer.

While the invention is described herein in terms of preferred embodiments and generally associated methods, the inventor contemplates that alterations and permutations of the preferred embodiments and methods will become apparent to those skilled in the art upon a reading of the specification and a study of the drawings. For instance, the drop-in modular trigger assembly could be made of any durable material.

The invention claimed is:

1. A trigger assembly for use in a weapon, the trigger assembly comprising:

a disconnector having (1) a catch edge that is configured to be urged by a spring to a position that restrains a hammer from rotation until a trigger is pulled and (2) a projection that interconnects the disconnector to a trigger shoe, the projection comprising (i) a neck and (ii) a head;

the trigger shoe having a slot for receiving the projection, wherein the head fits into the slot and the slot includes a gap configured to enable movement of the neck such that the trigger, when pulled, will urge the catch edge away from the hammer against the spring's urging thereby releasing the hammer to fire the weapon.

2. The trigger assembly of claim 1, wherein a thickness of the catch edge and a thickness of the hammer are equal.

3. The trigger assembly of claim 1, wherein the spring is in contact with the disconnector and the trigger shoe.

4. The trigger assembly of claim 1, wherein a thickness of the disconnector and a thickness of the trigger shoe are equal.

5. The trigger assembly of claim 1, wherein a thickness of the disconnector and a thickness of the hammer are equal.

6. The trigger assembly of claim 1, wherein the head is cylindrical.

7. The trigger assembly of claim 1, wherein the weapon is an AR-15 rifle.

8. The trigger assembly of claim 1, wherein the weapon is an AR-10 rifle.

9. The trigger assembly of claim 1, wherein the disconnector includes a bore for receiving the spring.

10. The trigger assembly of claim 1, wherein the trigger assembly is a drop-in trigger assembly with orifices and openings for mounting the assembly to the weapon.

11. The trigger assembly of claim 1, wherein the weapon is an AR-9 rifle.

12. The trigger assembly of claim 1, wherein the disconnector, the head, and the neck are machined out of a single piece.

* * * * *